US006813999B2

(12) United States Patent
Treml

(10) Patent No.: US 6,813,999 B2
(45) Date of Patent: Nov. 9, 2004

(54) INK PAD FOR SELF-INKING STAMP

(75) Inventor: Klemens Treml, Ried im Traunkreis (AT)

(73) Assignee: Trodant GmbH, Wels (AT)

( * ) Notice: Subject to any disclaimer, the term of this patent is extended or adjusted under 35 U.S.C. 154(b) by 0 days.

(21) Appl. No.: 10/470,374

(22) PCT Filed: Jan. 23, 2002

(86) PCT No.: PCT/AT02/00024

§ 371 (c)(1),
(2), (4) Date: Jul. 25, 2003

(87) PCT Pub. No.: WO02/058939

PCT Pub. Date: Aug. 1, 2002

(65) Prior Publication Data

US 2004/0055486 A1 Mar. 25, 2004

(30) Foreign Application Priority Data

Jan. 25, 2001 (AT) ..... A 123/2001

(51) Int. Cl.[7] ..... B41J 27/00

(52) U.S. Cl. ..... 101/104; 101/97; 101/98; 101/103

(58) Field of Search ..... 101/103, 104, 101/97, 98, 108, 109

(56) References Cited

U.S. PATENT DOCUMENTS 2,234,422 A 3/1941 Wiswell ..... 101/333
3,678,848 A * 7/1972 Roser et al. ..... 101/125
4,970,954 A * 11/1990 Weir et al. ..... 101/334
5,184,549 A * 2/1993 Imamaki et al. ..... 101/121
5,517,916 A * 5/1996 Dour et al. ..... 101/334
5,582,105 A * 12/1996 Miki et al. ..... 101/128.4
5,671,668 A * 9/1997 Shih ..... 101/104
5,850,787 A * 12/1998 Pichler ..... 101/105
5,996,493 A * 12/1999 Okumura et al. ..... 101/333

FOREIGN PATENT DOCUMENTS

EP 0804344 B1 11/1997 ..... B41K/1/40

* cited by examiner

*Primary Examiner*—Andrew H. Hirshfeld
*Assistant Examiner*—Dave A. Ghatt
(74) *Attorney, Agent, or Firm*—Karl Hormann

(57) ABSTRACT

Ink pad for a self-inking stamp which is provided with a housing with a support frame (1') and a stamp platen support (3) which by a swivel motion is movable in this housing from an idle position into a stamping position and which is connected to an actuator handle (2) moveable against a return spring relative to the housing, the ink pad (6) being insertible into a receiving shaft (8) of the housing by means of a substantially tub-shaped pad holder (7) and a sealing frame (9) extending about the periphery of the pad holder provided with a sealing lip (9') protruding from the pad holder which in the operational position of the pad holder in the receiving shaft of the stamp housing sealingly engages stamp platen support under elastic deformation.

8 Claims, 3 Drawing Sheets

INK PAD FOR SELF-INKING STAMP

The invention relates to an ink pad for a self-inking stamp which is provided with a housing with a support frame and a stamp platen support which by a swivel motion is movable in this housing from an idle position into a stamping position and which is connected to an actuator handle moveable against a return spring relative to the housing, the ink pad being insertible into a receiving shaft of the housing by means of a substantially tub-shaped pad holder.

Stamps and stamp pads of this kind are known, for instance, from EP 0,804,344. In these structures, the pad holder surrounds the ink pad directly, and in the inserted use position the stamp pad is substantially exposed to the environment which over time leads to evaporation of the solvent-containing stamp ink and to the pad becoming prematurely useless or that stamp imprints are of insufficient quality.

It is an object of the invention to avoid this deficiency, and it accomplishes this in a stamp pad of the kind referred to above by a sealing frame extending about the periphery the pad holder which is provided with a sealing lip protruding from the stamp holder which in the operational position of the pad holder in the receiving shaft of the stamp housing sealingly engages the stamp platen support by elastic deformation.

Preferably, the sealing frame including the sealing lip are fabricated by injection molding of a plastic, preferably a thermoplastic elastomeric material.

In accordance with a further characteristic of the invention, the sealing frame is arranged between the ink pad and the pad holder. Alternatively, the sealing frame may be provided at the exterior of the pad holder.

The invention provides for attaining a flawless seal of the stamp pad in the idle position of the stamp in which the stamp platen engages the stamp pad and prevents premature drying of the stamp pad as a result of evaporation of the stamp ink. The life expectancy of the stamp pad is increased in this manner and a uniform quality of imprints is ensured.

The invention will hereafter be described in greater detail with reference to the drawings in which.

Figure 1:
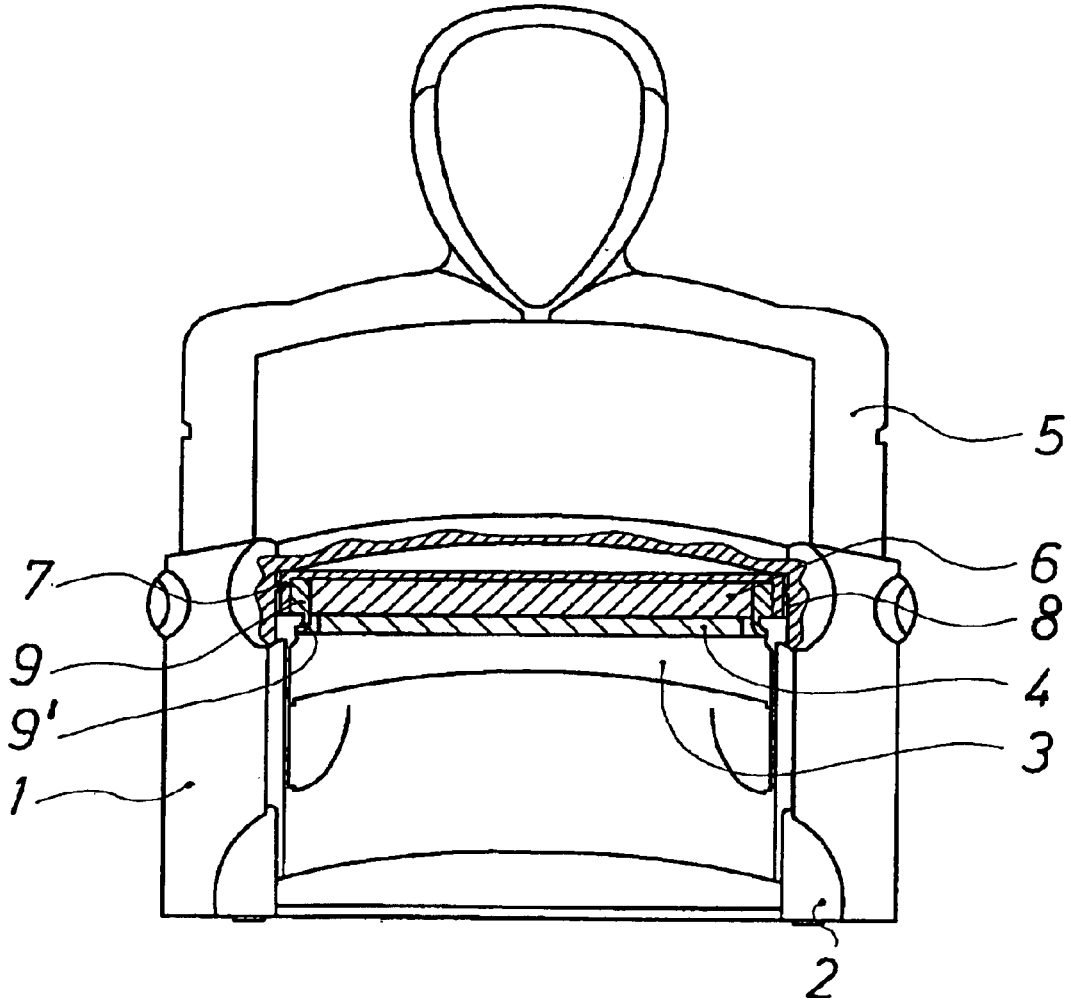
FIG. 1 is a view, partially in section, of a stamp with a stamp pad in accordance with the invention.

The self-inking stamp shown in FIG. 1 is provided with a stamp housing 1 which forms a frame 2 to be placed on a surface to be stamped and within which a stamp platen support 3 with a stamp platen 4 may by a swiveling motion of the stamp platen support be moved from an idle position to the stamping position. For actuating the stamp platen support, there are provided an actuator bracket 5 connected therewith and moveable against the bias of a return spring and a swivel mechanism (not shown) of the kind known from EP 0,804,344.

In its idle position the stamp platen 4 engages a stamp pad 6 which by means of a tub-shaped plastic pad holder 7 is inserted into a receiving shaft 8 of the housing 1.

Figure 2:
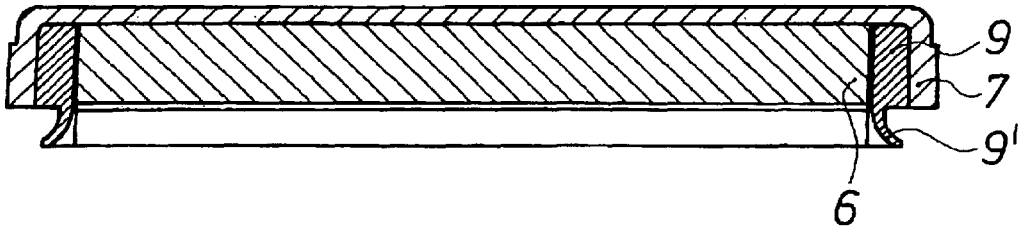
FIG. 2 is a cross-section through the stamp pad.
Figure 3:
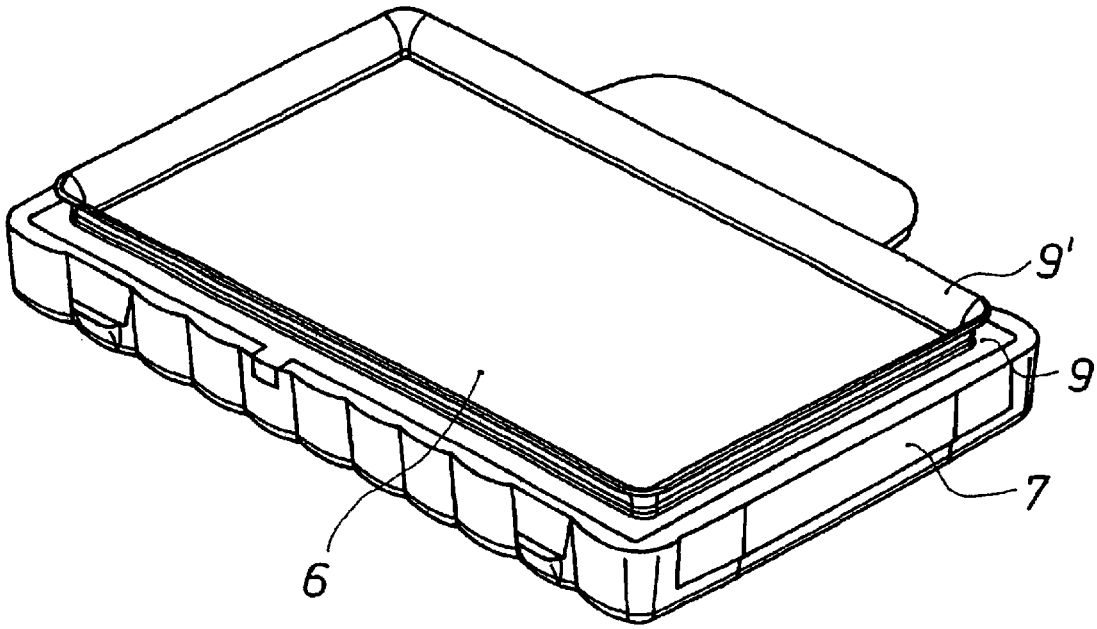
FIG. 3 is a perspective view from below of the stamp pad of FIG. 2.

As shown in FIGS. 2 and 3, a sealing frame 9 is provided between the stamp pad 6 and the pad holder 7, the frame 9 formed with a sealing lip 9' protruding downwardly from the holder being fabricated by injection molding, e.g. of TPE. The sealing lip is bent outwardly relative to the stamp pad 6 and tapers in the direction of its free end.

After inserting the pad holder 7 into the receiving shaft 8, the sealing lip 9' engages the stamp platen support 3 under elastic deformation, and in this manner seals the ink pad 6 against the environment.

Figure 4:
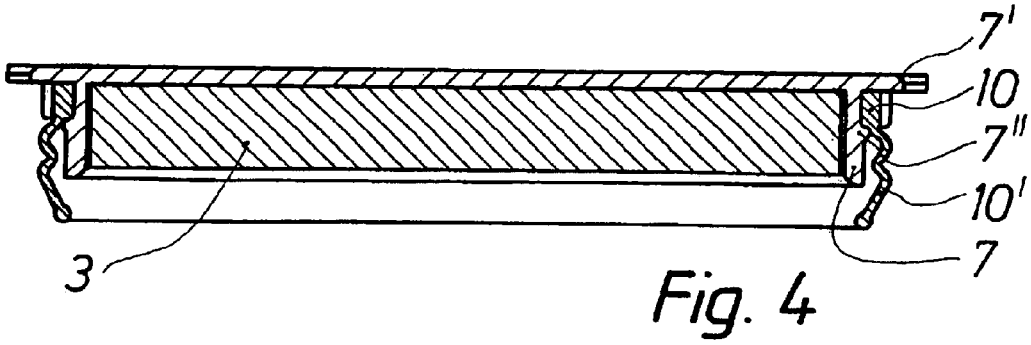
FIG. 4 is a sectional view of a further embodiment of the stamp pad in accordance with the invention.
Figure 5:
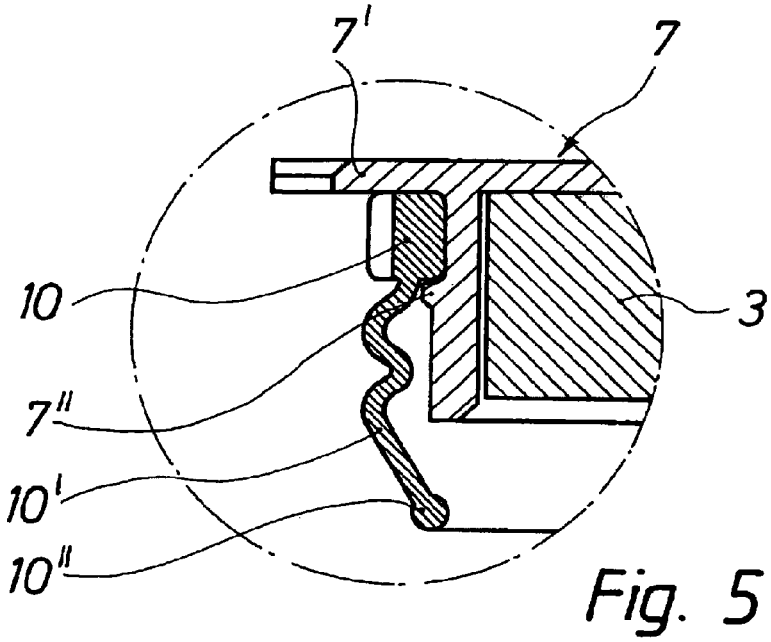
FIG. 5 Is a detail from FIG. 4.

In the embodiment shown in FIG. 4, the sealing frame 10 is arranged at the exterior of the pad holder 7 between a margin 7' of the bottom of the pad holder and a rib 7" of the wall of the pad holder. The sealing lip 10' which for receiving relatively thick stamp platens is structured high is formed with corrugations and terminates in a bead 10' disposed inwardly relative to the pad holder 7.

It will be understood that within the ambit of the inventive concept the described embodiments may be altered, especially in respect of the material of the sealing frame and the shape of the sealing lip.

What is claimed is:

1. An ink pad for use with a self-inking stamp provided with a housing having a support frame and a stamp platen support mounted in the housing for swiveling motion against the bias of a spring between an idle position and a stamping position and with means for forming a shaft for receiving the ink pad, the ink pad comprising:

an ink pad holder having a bottom wall and a periphery formed by a plurality of side walls protruding from the bottom wall;

a sealing frame extending from the periphery in substantially parallel relationship to the bottom wall; and an elastically deformable sealing lip protruding from the sealing frame in a direction opposite the bottom wall for engaging the stamp platen support in the idle position thereof for sealing the ink pad from the environment.

2. The ink pad of claim 1, wherein the sealing lip traces the periphery at a predetermined spacing therefrom.

3. The ink pad of claim 2, wherein the sealing frame is arranged between the ink pad and the pad holder.

4. The ink pad of claim 1, wherein the sealing frame and the sealing lip are made of a resilient material.

5. The ink pad of claim 4, wherein the sealing frame and the sealing lip are formed by injection molding of a thermoplastic elastomeric material.

6. The ink pad of claim 5, wherein the thermoplastic elastomeric material is TPE.

7. The ink pad of claim 1, wherein the sealing frame is arranged at the exterior of the pad holder and the sealing lip is formed with corrugation substantially parallel to the bottom wall.

8. The ink pad of claim 7, wherein the sealing lip is provided with a free margin facing away from the bottom wall and formed by a bead.

* * * * *

UNITED STATES PATENT AND TRADEMARK OFFICE

CERTIFICATE OF CORRECTION

PATENT NO. : 6,813,999 B2
DATED : November 9, 2004
INVENTOR(S) : Klemens Treml

It is certified that error appears in the above-identified patent and that said Letters Patent is hereby corrected as shown below:

Title page,
Item [73], Assignee, should read -- Assignee: Trodat GmbH., Wels (AT) --.

Signed and Sealed this

Twenty-fourth Day of May, 2005

JON W. DUDAS
*Director of the United States Patent and Trademark Office*